US006103628A

United States Patent [19]

Talieh

[11] Patent Number: 6,103,628

[45] Date of Patent: Aug. 15, 2000

[54] REVERSE LINEAR POLISHER WITH LOADABLE HOUSING

[75] Inventor: Homayoun Talieh, San Jose, Calif.

[73] Assignee: Nutool, Inc., Milpitas, Calif.

[21] Appl. No.: 09/201,928

[22] Filed: Dec. 1, 1998

[51] Int. Cl.[7] ..... H01L 21/00

[52] U.S. Cl. ..... 438/692; 156/345 LP; 216/88; 438/745

[58] Field of Search ..... 438/691, 692, 438/693, 745, 747; 216/38, 88, 89; 156/345 LP

[56] References Cited

U.S. PATENT DOCUMENTS

| | | | |
|---|---|---|---|
| 4,802,309 | 2/1989 | Heynacher . | |
| 5,245,796 | 9/1993 | Miller et al. | 438/692 X |
| 5,335,453 | 8/1994 | Baldy et al. . | |
| 5,558,568 | 9/1996 | Talieh et al. | 451/303 |
| 5,650,039 | 7/1997 | Talieh | 156/636 |
| 5,679,212 | 10/1997 | Kato et al. | 156/345 X |
| 5,692,947 | 12/1997 | Talieh et al. | 451/41 |
| 5,762,751 | 6/1998 | Bleck et al. | 156/345 |
| 5,770,521 | 6/1998 | Pollock | 438/692 |
| 5,807,165 | 9/1998 | Uzoh et al. | 451/41 |

FOREIGN PATENT DOCUMENTS

EP 0 517 594 A 12/1992 European Pat. Off. .

DE 31 13 204 A 10/1982 Germany .

WO 97 20660 A 6/1997 WIPO .

OTHER PUBLICATIONS

J.M. Steigerwald, R. Zirpoli, S.P. Murarka, D. Price and R.J. Gutman, "Pattern Geometry Effects in the Chemical–Mechanical Polishing of Inlaid Copper Structures", Oct. 1994, pp. 2842–2848.

*Primary Examiner*—William Powell

*Attorney, Agent, or Firm*—Pillsbury Madison & Sutro LLP

[57] ABSTRACT

The present invention is directed to a method and apparatus for polishing a surface of a semiconductor wafer using a pad moveable in both forward and reverse directions. In both VLSI and ULSI applications, polishing the wafer surface to complete flatness is highly desirable. The forward and reverse movement of the polishing pad provides superior planarity and uniformity to the surface of the wafer. The wafer surface is pressed against the polishing pad as the pad moves in both forward and reverse directions while polishing the wafer surface. During polishing, the wafer is supported by a wafer housing having a novel wafer loading and unloading method.

18 Claims, 5 Drawing Sheets

REVERSE LINEAR POLISHER WITH LOADABLE HOUSING

FIELD OF THE INVENTION

The present invention relates to the field of chemical mechanical polishing. More particularly, the present invention relates to a method and apparatus for polishing a semiconductor wafer to a high degree of planarity and uniformity. This is achieved when the semiconductor wafer is polished with pads at high bi-directional linear or reciprocating speeds.

BACKGROUND OF THE INVENTION

Chemical mechanical polishing (CMP) of semiconductor wafers for VLSI and ULSI applications has important and broad application in the semiconductor industry. CMP is a semiconductor wafer flattening and polishing process that combines chemical removal of semiconductor layers such as insulators, metals, and photoresists with mechanical buffering of a wafer surface. CMP is generally used to flatten/polish wafers after crystal growing during the wafer fabrication process, and is a process that provides global planarization of the wafer surface. For example, during the wafer fabrication process, CMP is often used to flatten/polish the profiles that build up in multilevel metal interconnection schemes. Achieving the desired flatness of the wafer surface must take place without contaminating the desired surface. Also, the CMP process must avoid polishing away portions of the functioning circuit parts.

Conventional systems for the chemical mechanical polishing of semiconductor wafers will now be described. One conventional CMP process requires positioning a wafer on a holder rotating about a first axis and lowered onto a polishing pad rotating in the opposite direction about a second axis. The wafer holder presses the wafer against the polishing pad during the planarization process. A polishing agent or slurry is typically applied to the polishing pad to polish the wafer. In another conventional CMP process, a wafer holder positions and presses a wafer against a belt-shaped polishing pad while the pad is moved continuously in the same linear direction relative to the wafer. The so-called belt-shaped polishing pad is movable in one continuous path during this polishing process. These conventional polishing processes may further include a conditioning station positioned in the path of the polishing pad for conditioning the pad during polishing. Factors that need to be controlled to achieve the desired flatness and planarity include polishing time, pressure between the wafer and pad, speed of rotation, slurry particle size, slurry feed rate, the chemistry of the slurry, and pad material.

Although the CMP processes described above are widely used and accepted in the semiconductor industry, problems remain. For instance, there remains a problem of predicting and controlling the rate and uniformity at which the process will remove materials from the substrate. As a result, CMP is a labor intensive and expensive process because the thickness and uniformity of the layers on the substrate surface must be constantly monitored to prevent overpolishing or inconsistent polishing of the wafer surface.

Accordingly, an inexpensive and more consistent method and apparatus for polishing a semiconductor wafer are needed.

SUMMARY OF THE INVENTION

It is an object of the present invention to provide a method and apparatus that polishes a semiconductor wafer with uniform planarity.

It is another object of the present invention to provide a method and apparatus that polishes a semiconductor wafer with a pad having high bidirectional linear or reciprocating speeds.

It is yet another object of the present invention to provide a method and apparatus that reduces the size of the polishing station thereby reducing the space and cost of such station.

It is another object of the present invention to provide a method and apparatus that eliminates or reduces the need for pad conditioning.

It is yet another object of the present invention to provide a method and apparatus for efficiently loading and unloading a semiconductor wafer onto a wafer housing.

These and other objects of the present invention are obtained by providing a method and apparatus that polishes a wafer with a pad having high bidirectional linear speeds. In summary, the present invention includes a polishing pad secured to a timing belt mechanism that allows the pad to move in a reciprocating manner, i.e. in both forward and reverse directions, at high speeds. The constant forward and reverse movement of the polishing pad as it polishes the wafer provides superior planarity and across the wafer surface. The wafer housing of the present invention can also be used to securely hold the wafer as it is being polished.

BRIEF DESCRIPTION OF THE DRAWINGS

These and other objects and advantages of the present invention will become apparent and more readily appreciated from the following detailed description of the presently preferred exemplary embodiment of the invention taken in conjunction with the accompanying drawings, of which.

DETAILED DESCRIPTION OF THE PREFERRED EMBODIMENTS

Figure 1:
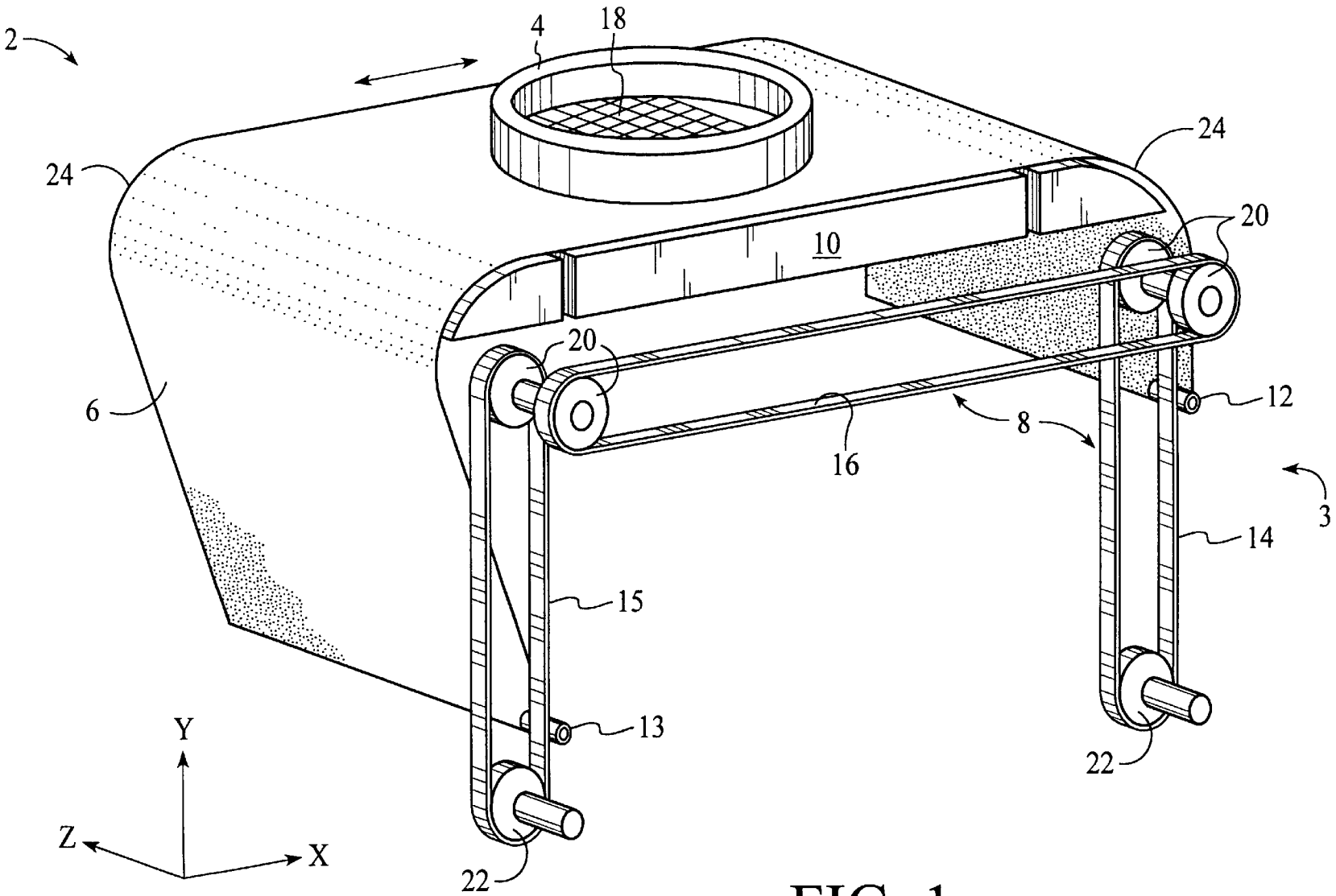
FIG. 1 illustrates a perspective view of a method and apparatus in accordance with the preferred embodiment of the present invention.

The preferred embodiment of the present invention will now be described with reference to FIGS. 1–8, wherein like components are designated by like reference numerals throughout the various figures. The present invention is directed to a CMP method and apparatus that can operate at high bi-directional linear pad or reciprocating speeds and a reduced foot-print. The high bidirectional linear pad speeds optimize planarity efficiency while the reduced foot-print reduces the cost of the polishing station. Further, because the polishing pad is adapted to travel in bi-directional linear directions, this reduces the pad glazing effect, which is a common problem in conventional CMP polishers. Because the pad travels in bidirectional linear directions, the pad is substantially self conditioning.

Figure 2:
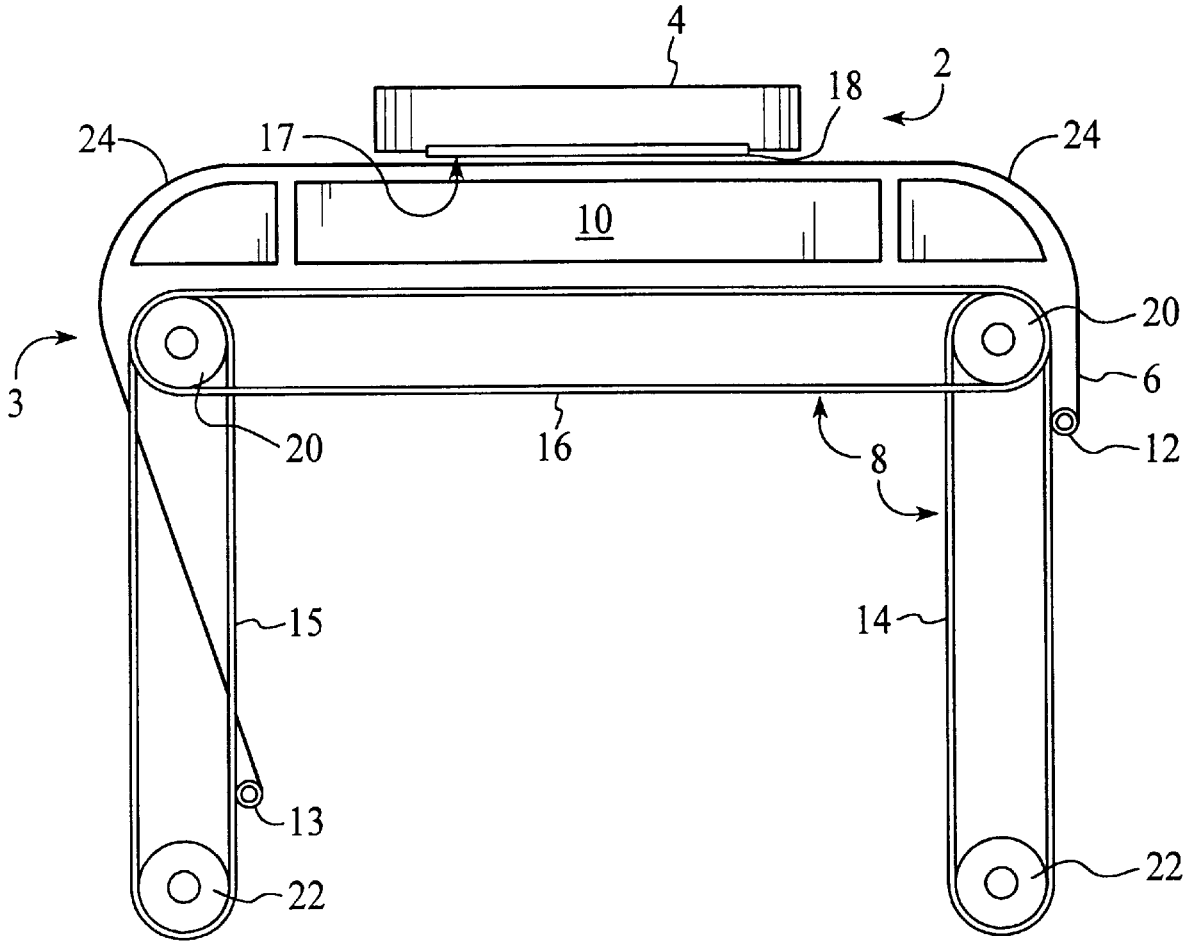
FIG. 2 illustrates a side view of a method and apparatus in accordance with the preferred embodiment of the present invention.

FIG. 1 illustrates a perspective view and FIG. 2 illustrates a side view of an apparatus of a preferred embodiment of the present invention. The wafer polishing station 2 includes a bidirectional linear, or reverse linear, polisher 3 and a wafer housing 4. The wafer housing 4 (which can rotate about its center axis and move side to side, as known) securely positions a wafer 18 so that a surface 17 may be polished. In accordance with the present invention, a novel method and apparatus of and unloading the wafer 18 onto the wafer housing 4 is described more fully later herein.

The reverse linear polisher 3 includes a polishing pad 6 for polishing the wafer surface 17, a mechanism 8 for driving the polishing pad 6 in a bidirectional linear or reciprocating (forward and reverse) motion, and a support plate 10 for supporting the pad 6 as the pad 6 polishes the wafer surface 17. A polishing agent or slurry containing a chemical that oxidizes and mechanically removes a wafer layer is flowed between the wafer 18 and the polishing pad 6. The polishing agent or slurry such as colloidal silica or fumed silica is generally used. The polishing agent or slurry generally grows a thin layer of silicon dioxide or oxide on the wafer surface 17, and the buffering action of the polishing pad 6 mechanically removes the oxide. As a result, high profiles on the wafer surface 17 are removed until an extremely flat surface is achieved. It should also be noted that the size of the particles from the polishing agent or slurry used to polish the wafer surface 17 is preferably at least two or three times larger than the feature size of the wafer surface 17. For example, if the feature size of the wafer surface 17 is 1 micron, then the size of the particles should be at least 2 or 3 microns.

The underside of the polishing pad 6 is attached to a flexible but firm and flat material (not shown) for supporting the pad 6. The polishing pad 6 is generally a stiff polyurethane material, although other suitable materials may be used that is capable of polishing wafer surface 17.

In accordance with the preferred embodiment of the present invention, the driving or transmission mechanism 8 for driving the polishing pad 6 in a bi-directional linear motion will now be described. Although FIGS. 1–2 illustrate only one driving mechanism 8 from the frontside of the reverse linear polisher 3, it is understood that on the backside of the reverse linear polisher 3, a similar driving mechanism 8 is also present. Driving mechanism 8 includes three timing belts, two vertically suspending timing belts 14, 15 and one horizontally suspending timing belt 16. The timing belts 14, 15, and 16 may be formed of any suitable material such as stainless steel or high strength polymers having sufficient strength to withstand the load applied to the belts by the wafer 18. One end of the vertically suspending timing belts 14, 15 is secured to rollers 20 while the other end is secured to rollers 22. Likewise, each end of the horizontally suspending timing belt 16 is secured to rollers 20. As illustrated in FIG. 1, it is noted that the horizontally suspending timing belt 16 is placed in a z-plane slightly outside the z-plane of the vertically suspending timing belts 14, 15.

Rollers 20 link the two vertically suspending timing belts 14, 15 with the horizontally suspending timing belt 16 so that each belts rate of rotation depends on the rate of rotation of the other belts. The rollers 20 and 22 retain the timing belts 14, 15, and 16 under proper tension so that the polishing pad 6 is sufficiently rigid to uniformly polish the wafer surface 17. The tension of the timing belts may be increased or decreased as needed by adjusting the position of rollers 22 relative to roller 20.

Although the present invention describes a driving mechanism having three timing belts secured on four rollers, it is understood that any suitable number of rollers and/or timing belts, or a driving mechanism that does not rely on rollers/belts, i.e. a seesaw mechanism, such that it provides the bidirectional linear or reciprocating motion, are intended to be within the scope and spirit of the present invention.

An important aspect of the present invention is that the polishing pad 6 and the corresponding support material is adapted to bend at an angle at corners 24, which angle is preferably about 90°. Each end of the polishing pad 6 is attached to a point on the two vertically positioned timing belts 14, 15 by attachment 12, 13. One end of the polishing pad 6 is secured to attachment 12, and the other end is secured to attachment 13. Attachments 12 and 13 are preferably a sleeve and rod, as more fully described later herein. Referring again to FIGS. 1 and 2, as one end of the polishing pad 6 travels vertically downward with the assistance of timing belt 14 and attachment 12, the other end of the polishing pad 6 travels vertically upward with the assistance of timing belt 15 and attachment 13. The mechanical alignment of the timing belts 14, 15, and 16 with the rollers 20 and 22 allows such movement to occur.

In order to drive the timing belts 14, 15, and 16 to a desired speed, a conventional motor (not shown) is used to rotate rollers 20 and/or 22. The motor is connected to rollers 20 or 22 or to any suitable element connected to rollers 20 and/or 22, and it provides the necessary torque to rotate rollers 20 and 22 to a desired rate of rotation. The motor directly/indirectly causes rollers 20 and 22 to rotate so that the timing belts 14, 15, and 16 are driven at a desired speed in both forward and reverse directions. For instance, when attachment 13 reaches roller 22 during its downward motion, it will reverse the direction of the polishing pad 6 as attachment 13 now travels upward. Soon thereafter, the same attachment 13 now reaches roller 20 and again changes direction in a downward direction. The reciprocating movement of attachment 13 allows the polishing pad 6 to move in both forward and reverse directions. Preferably, the speed at which the polishing pad 6 is moved is within the range of approximately 100 to 600 feet per minute for optimum planarization of the wafer surface 17. However, it should be understood that the speed of the polishing pad 6 may vary depending on many factors (size of wafer, type of pad, chemical composition of slurry, etc.). Further, the pad 6 may be moved in both bi-directional linear directions at a predetermined speed, which preferably averages between 100 to 600 feet per minute.

Figure 4:
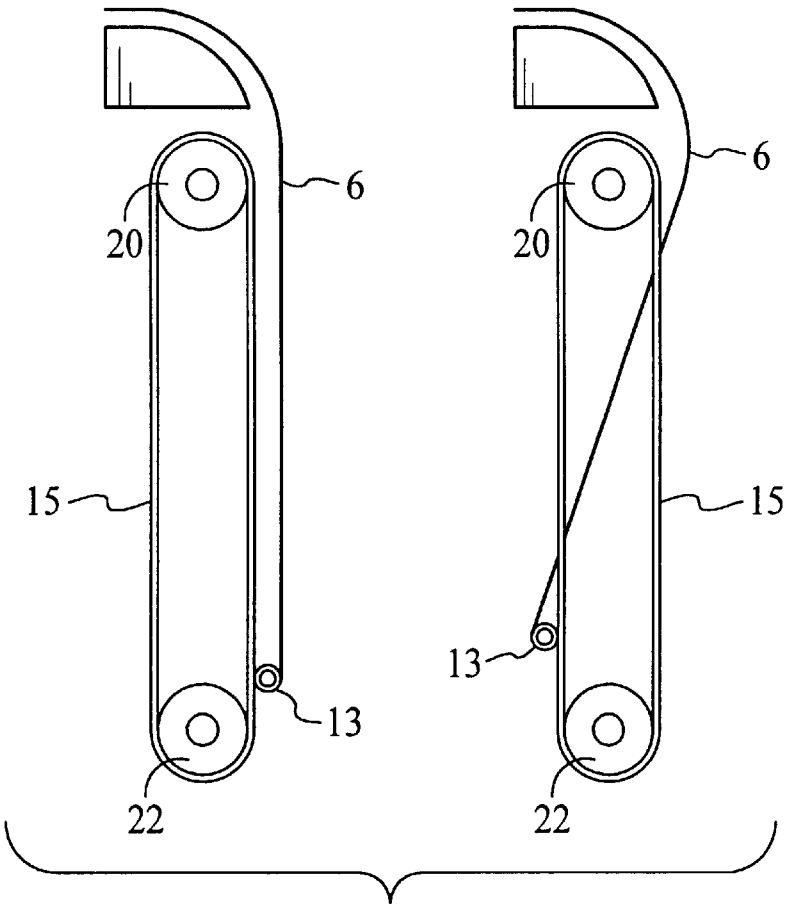
FIG. 4 illustrates side views of a polishing pad moving around the timing belt rollers in accordance with the preferred embodiment of the present invention.
Figure 3:
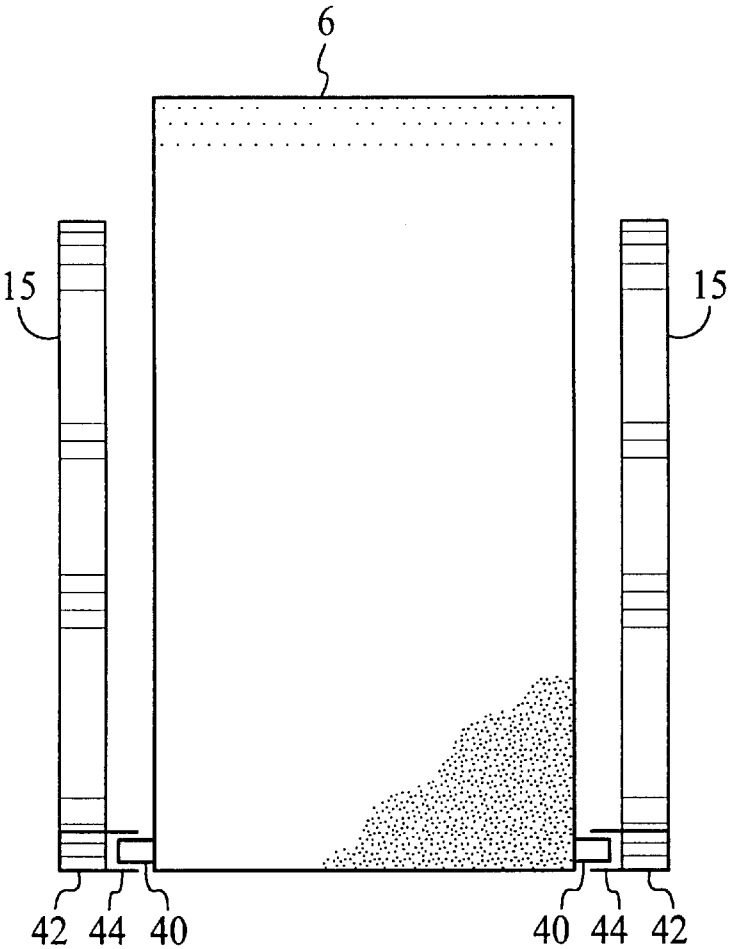
FIG. 3 illustrates a front view of a method and apparatus for attaching a polishing pad to timing belts in accordance with the preferred embodiment of the present invention.

FIG. 3 illustrates a front view and FIG. 4 illustrates a side view of a method and apparatus for attaching the polishing pad 6 to the timing belts 14, 15 in accordance with the preferred embodiment of the present invention. As described earlier herein, the underside of the polishing pad 6 is attached to the flexible but firm and flat material, which is non-stretchable. At each end of the material, and thus the ends of the polishing pad 6, a rod 40 is attached. The rod 40 extends horizontally from the pad 6 as shown in FIG. 3. A sleeve 42, i.e. a cylinder or a slit, is also attached to each of the vertically suspending timing belts 14, 15, and a portion 44 of the sleeve 42 extends horizontally to join the rod 40, as again illustrated in FIG. 3. When the rod 40 and the sleeve 42 are joined, this allows the polishing pad 6 to travel bi-directional with high linear speeds without the problem of having the polishing pad 6 being wrapped around the rollers 20, 22. FIG. 4 further illustrates a side view of the polishing pad 6 as it rotates around the rollers 20, 22.

As described earlier, the polishing pad 6 bends at an angle, preferably about 90° at the two comers 24. This approach is beneficial for various reasons. In accordance with the present invention, the length of the polishing pad 6 on the horizontal plane needed to polish the wafer surface 17 needs to be only slightly longer than the wafer 18 diameter. Optimally, the entire length of polishing pad should be only slightly longer than three times the wafer 18 diameter. This allows the most efficient and economical use of the entire polishing pad 6. During polishing, slurry or other agent may be applied to the portions of the polishing pad 6 that are not in contact with the wafer surface 17. The slurry or other agent can be applied to the polishing pad preferably at locations near corners 24. The configuration of the polishing pad 6 described above also decreases the size of a support plate 10 needed to support the pad 6. Furthermore, though the bi-directional linear movement provides for a substantially self conditioning pad, a conditioning member can also be disposed on or about this same location.

The novel approach described above has many other advantages and benefits. For example, the CMP device of the present invention takes up less space than most traditional CMP devices because about two-thirds of the polishing pad 6 can be in a vertical position. The bidirectional linear movement of the CMP device further increases the pad usage efficiency because the reciprocating movement of the pad 6 provides a self-conditioning function, since the pad 6 is moving in different, preferably opposite, directions.

In accordance with the present invention, only one wafer is generally polished during a single time. As described above, the polishing pad 6 moves bidirectional with high linear speeds so as to uniformly polish the wafer surface 17. Because high pad speeds are needed to the polish wafer surface 17, the momentum, and thus inertia created is very high. Thus, as the polishing pad 6 reverses direction, sufficient energy is needed to keep the pad moving at desired speeds. If the total area (length and width) of the polishing pad 6 is minimized, the energy needed to keep the pad moving at desired speeds is decreased accordingly. Thus, by limiting the length of the polishing pad 6, a conventional motor can handle the necessary energy needed to keep the pad moving at desired speeds in both forward and reverse directions. The entire length of the polishing pad 6 should be slightly longer than two-diameter lengths of the wafer 18, and preferably three-diameter lengths of the wafer 18. The reason for this is so that the polishing pad 6 may be conditioned and slurry may be applied to both sides of the pad opposite where the wafer 18 is positioned, in close proximity to corners 24.

Although the present invention is adapted to polish a single wafer at one time, one skilled in the art may modify the preferred embodiment of the invention in order to polish multiple wafers at one time. Slurry (not shown) can be applied to the surface of the polishing pad 6 in conventional manners and the pad 6 can also further be conditioned in conventional manners.

Figure 5:
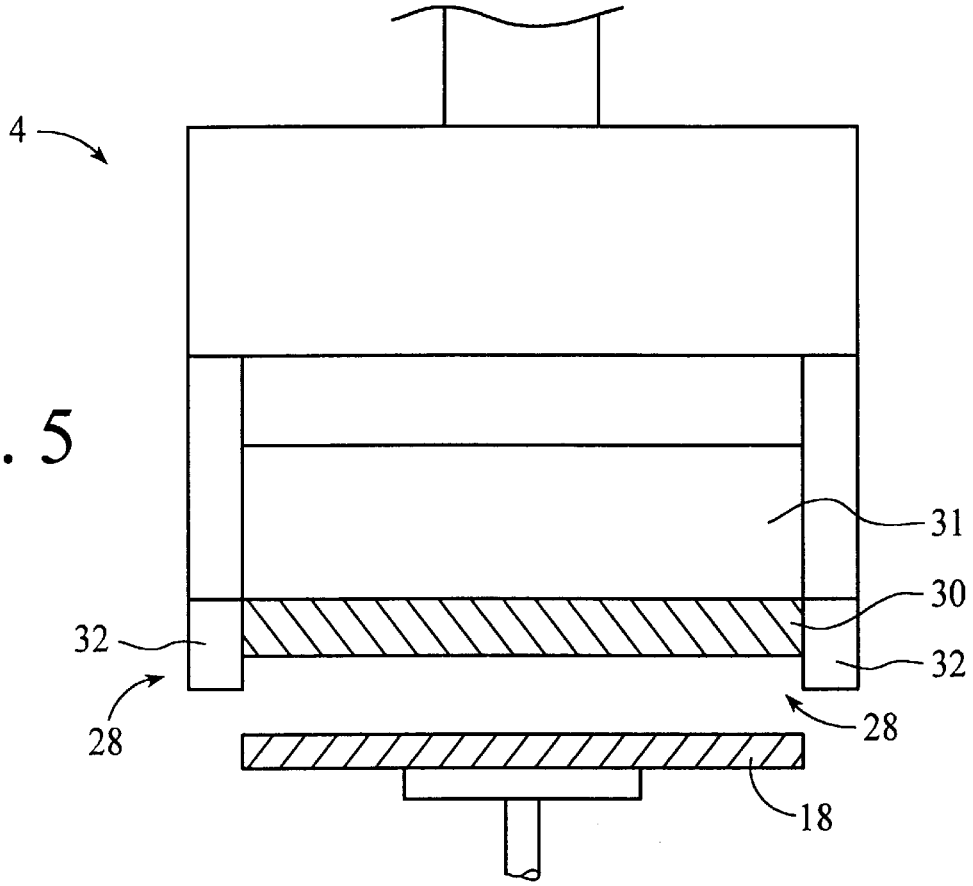
FIG. 5 illustrates a side view of a wafer housing adapted to load and unload a wafer onto a wafer housing in accordance with the preferred embodiment of the present invention.

Next, with reference to FIG. 5, a wafer housing 4 in accordance with the preferred embodiment of the present invention will now be described. Wafer housing 4 includes a nonconductive, preferably circular, head assembly 28 with a cavity 29 that is preferably a few millimeters deep at its center and having a resting pad 30 thereof. The wafer 18 is loaded into the cavity 29, backside first, against the resting pad 30. A conventional type of securing mechanism 31 (i.e. vacuum) is used to ensure that the wafer 18 is securely positioned with respect to the wafer head assembly 28 while the wafer 18 is being polished. The resting pad 30 may also be of a type that secures the wafer 18 by suctioning the backside of wafer 18 when the resting pad 30 is wet.

As described above, the reverse linear polisher 3 may polish the wafer 18 during various stages of the wafer fabrication process. Accordingly, a method for loading the wafer 18 into the cavity 29 so that an additional loading mechanism is not needed will be described with reference to FIG. 6. First, the wafer housing 4 is aligned to load the wafer 18 into the cavity 29. The head assembly 28 includes a pin housing 32 adapted to move up and down with respect to the cavity 29 using a motor or pneumatic control (not shown). During loading of the wafer 18, the pin housing 32 extends down from an original position, which is illustrated by the dashed lines, below the surface 17 of the wafer 18. At least three pins 34 are then automatically caused to protrude out of the pin housing 32 using a conventional retraction device under motor control so that the wafer 18 can be picked up and loaded into the cavity 29 of the head assembly 28. With the pins 34 protruding out, the pin housing 32 automatically retracts back to its original position, and thus the wafer 18 is loaded into cavity 29. When the head assembly 28 and the resting pad 30 secures the position of the wafer 18, as described above, the pins 34 automatically retract back into the pin housing 32 and the pin housing 32 retracts back to its original position so that the wafer 18 may be polished, as illustrated in FIG. 7.

Referring back to FIGS. 1 and 2, after the wafer 18 is securely loaded onto the wafer housing 4, the wafer housing 4 is automatically lowered until the wafer surface 17 is in contact with the polishing pad 6. The polishing pad 6 polishes the wafer surface 17 in accordance with the method described herein; the wafer 18 is then ready to be unloaded from the wafer housing 4.

Figure 6:
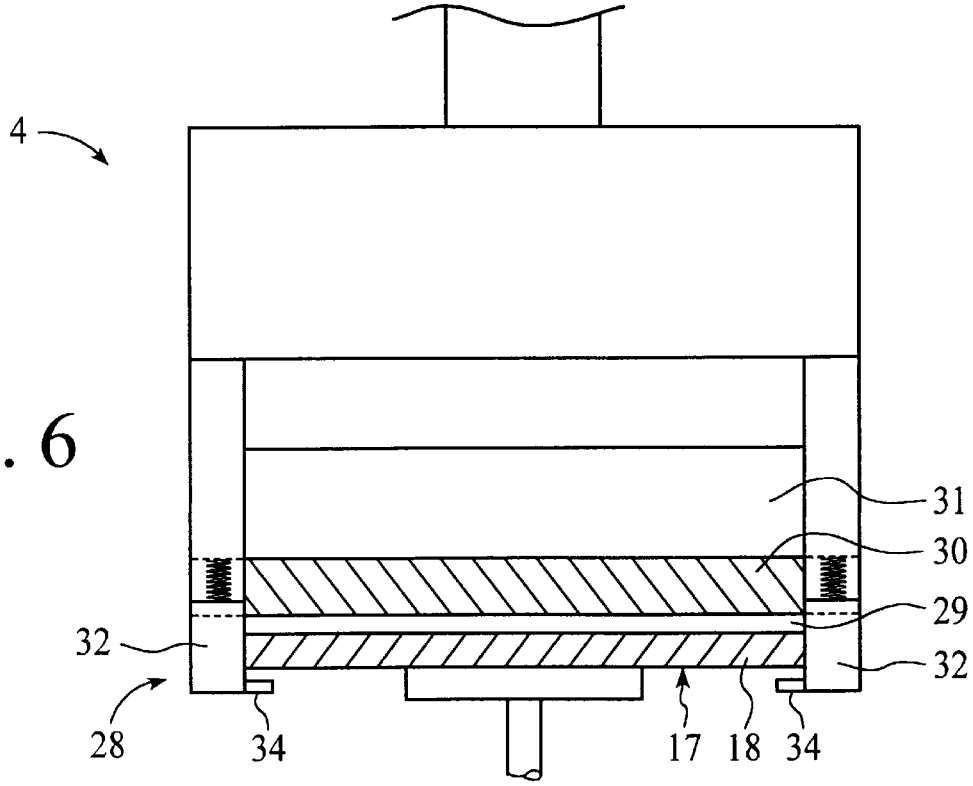
FIG. 6 illustrates a side view of a wafer housing having protruding pins adapted to load/unload a wafer onto a wafer housing in accordance with the preferred embodiment of the present invention.
Figure 7:
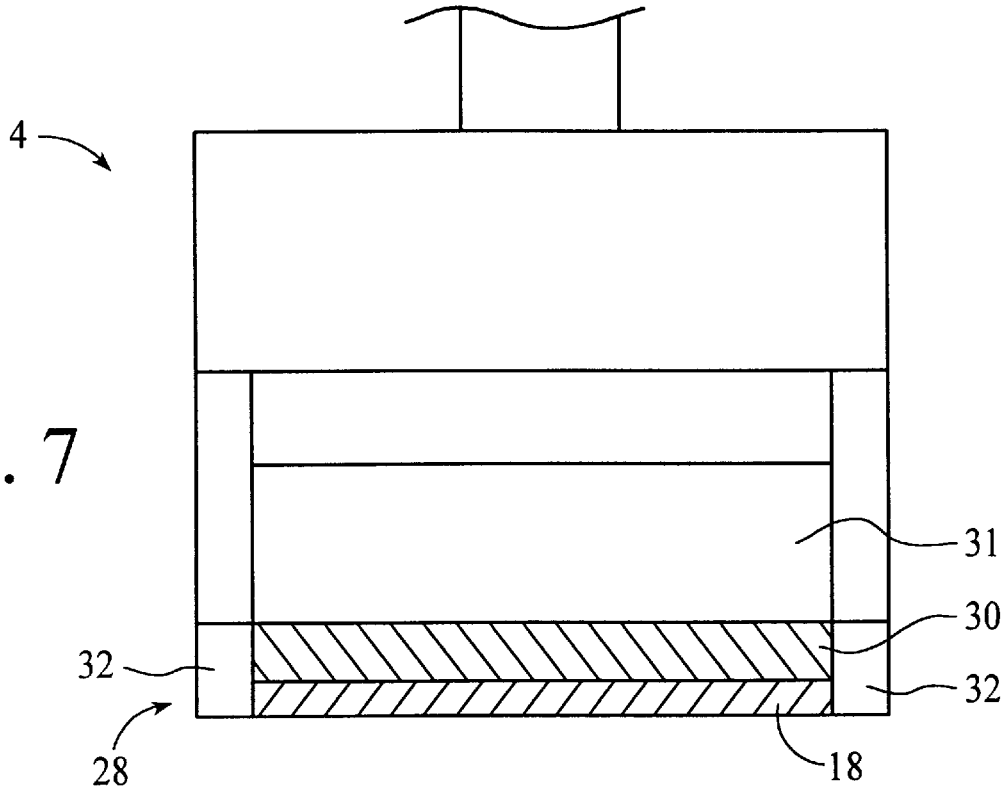
FIG. 7 illustrates a side view of a wafer loaded onto a wafer housing in accordance with the preferred embodiment of the present invention.

With reference to FIG. 6, the wafer 18 is unloaded from the wafer housing 4 using essentially a reverse order of the loading steps. After polishing the wafer 18, the wafer housing 4 is raised from the polishing pad 6, and the pin housing 32 extends down from its original position, which is illustrated by the dashed lines, below the surface 17 of the wafer 18. The pins 34 are then automatically caused to protrude out so that the wafer 18 may be supported when unloaded from the cavity 29. With the pins 34 protruding, the vacuum is reversed with opposite air flow, thus dropping the wafer 18 away from head assembly 28 and onto the pins 34 (i.e., wafer 18 is positioned from the resting pad 30 onto the pins 34). From this position, the wafer can then be transported to the next fabrication processing station.

Figure 8:
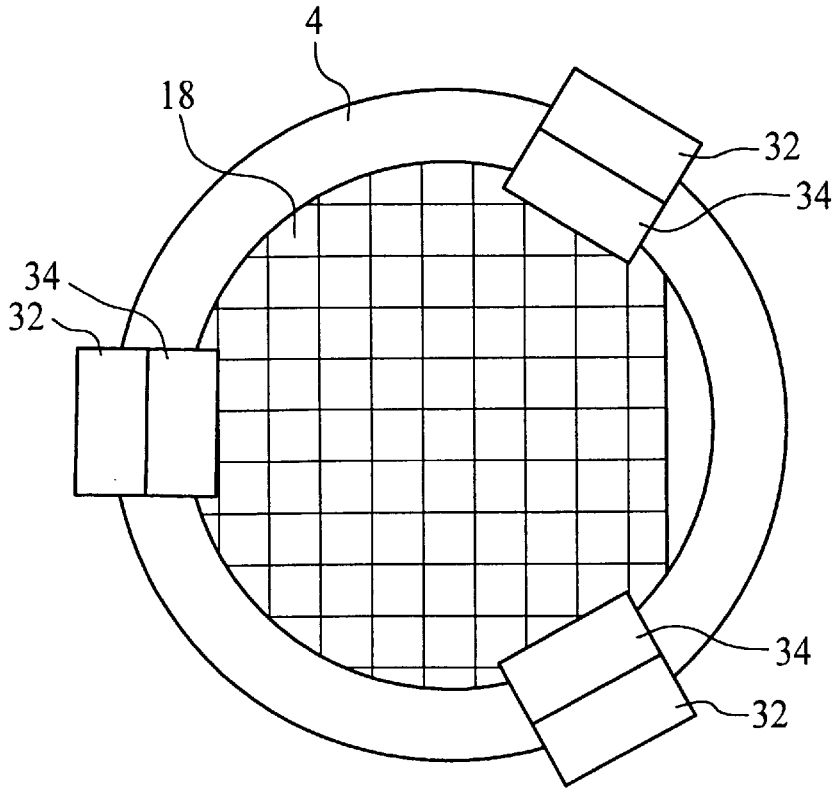
FIG. 8 illustrates a bottom view of a wafer being loaded and unloaded onto a wafer housing by three pins in accordance with the preferred embodiment of the present invention.

FIG. 8 illustrates a bottom view of the wafer 18 surface being loaded and unloaded into the cavity 29 by the pins 34. Although FIG. 8 illustrates three protruding pins 34, it should be understood that more than three pins, or an alternative support mechanism, may be used in accordance with the present invention.

Referring again to FIGS. 1–2, the support plate 10 for supporting the polishing pad 6 will now be described. The polishing pad 6 is held against the wafer surface 17 with the support of the support plate 10, which may be coated with a magnetic film. The backside of the support material to which the polishing pad 6 is attached may also be coated with a magnetic film, thus causing the polishing pad 6 to levitate off the support plate 10 while it moves at a desired speed. It should be understood that other conventional methods could be used to levitate the polishing pad 6 off the support plate 10 while it polishes wafer surface 17, such as air, lubricant, and/or other suitable liquids.

It is to be understood that in the foregoing discussion and appended claims, the terms "wafer surface" and "surface of the wafer" include, but are not limited to, the surface of the wafer prior to processing and the surface of any layer formed on the wafer, including oxidized metals, oxides, spun-on glass, ceramics, etc.

Although various preferred embodiments of the present invention have been disclosed for illustrative purposes, those skilled in the art will appreciate that various modifications, additions and/or substitutions are possible without departing from the scope and spirit of the present invention as disclosed in the claims.

I claim:

1. A chemical mechanical polishing device for polishing a surface of a semiconductor wafer, comprising:

a wafer housing adapted to support the wafer; and a polishing station having a pad that polishes the surface of the wafer with bi-directional linear movement.

2. A chemical mechanical polishing device of claim 1, wherein the bi-directional linear movement is obtained by alternatively moving the pad in forward and reverse directions.

3. A chemical mechanical polishing device of claim 2, wherein the pad is moved in forward and reverse directions with a transmission mechanism that includes a motor that has a shaft rotating in a single direction.

4. A chemical mechanical polishing device of claim 3, wherein the transmission mechanism comprises:

a horizontally suspending timing belt;

a first set of rollers adapted to secure the horizontally suspending timing belt;

a second set of rollers; and two vertically suspending timing belts connected to each end of the pad, each of the vertically suspending timing belts secured by one of the first set of rollers and one of the second set of rollers.

5. A chemical mechanical polishing device of claim 3, wherein the transmission mechanism is adapted to move the pad at approximately 100 to 600 feet per minute.

6. A chemical mechanical polishing device of claim 1, wherein the wafer housing comprises:

a head assembly having a cavity adapted to support the wafer and a movable pin housing that includes pins adapted to protrude in and out of the pin housing.

7. A chemical mechanical polishing device of claim 1, wherein the polishing station further comprises a support plate adapted to support the pad as the pad polishes the surface of the wafer.

8. A chemical mechanical polishing device of claim 1, wherein a pad length is at least two times a wafer diameter length.

9. A chemical mechanical polishing device of claim 1, wherein a pad length is at least three times a wafer diameter length.

10. A chemical mechanical polishing device of claim 1, wherein a pad length on a horizontal plane is about one wafer diameter length.

11. A method of polishing a surface of a semiconductor wafer, the method comprising the steps of:

supporting the wafer such that the surface of the wafer is exposed to a polishing pad; and polishing the surface of the wafer by moving the polishing pad bidirectional linearly.

12. A method of polishing the surface of the semiconductor wafer according to claim 11, the polishing step further comprising the step of moving the pad in forward and reverse directions.

13. A method of polishing the surface of the semiconductor wafer according to claim 12, wherein the pad is moved in forward and reverse directions with a transmission mechanism that generates the bidirectional linear movement from a motor that has a shaft rotating in a single direction.

14. A method of polishing the surface of the semiconductor wafer according to claim 13, wherein the transmission mechanism is adapted to move the pad at approximately 100 to 600 feet per minute.

15. A method of polishing the surface of the semiconductor wafer according to claim 11, the polishing step further comprising the steps of:

rotating a plurality of rollers;

moving a plurality of timing belts secured to the plurality of rollers;

moving the polishing pad bidirectional linearly, the polishing pad being attached to at least two of the plurality of timing belts; and polishing the surface of the wafer as the polishing pad makes contact with the surface.

16. A method of polishing the surface of the semiconductor wafer according to claim 11, the supporting step further comprising the step of securing the wafer in a cavity of a wafer housing.

17. A method of polishing the surface of the semiconductor wafer according to claim 11, the supporting step further comprising the steps of:

loading the wafer onto a cavity of a wafer housing having a movable pin housing and retractable pins disposed on a section of the pin housing;

positioning the section of the pin housing below the surface of the wafer;

extending the pins from the section of the pin housing, the pins thus providing support for the wafer that is insertable thereon;

moving the pin housing so that the wafer is disposed near the surface of the wafer housing;

loading the wafer onto the cavity of the wafer housing and off of the pins;

retracting the pins into the section of the pin housing; and clearing the pin housing from the surface of the wafer housing.

18. A method of polishing a surface of a semiconductor wafer, the method comprising the steps of:

chemical mechanical polishing of the surface of the wafer using a pad moving in a first direction at a predetermined speed; and chemical mechanical polishing of the surface of the wafer using the pad in a second direction opposite the first direction with the pad moving at the predetermined speed, the predetermined speed being between 100 to 600 feet per minute.

* * * * *

UNITED STATES PATENT AND TRADEMARK OFFICE

CERTIFICATE OF CORRECTION

PATENT NO. : 6,103,628
DATED : August 15, 2000
INVENTOR(S) : Homayoun Talieh

It is certified that error appears in the above-identified patent and that said Letters Patent is hereby corrected as shown below:

Title page,
Item [56] insert the following:
5,810,964 09/22/98 Shiraishi et al.
5,961,372 10/05/99 Shendon et al.

Column 2,
Lines 3 and 16, change "bidirectional" to -- bi-directional --.
Line 22, change "and across" to -- and uniformity across --.

Column 3,
Lines 4, 10 and 15, change "bidirectional" to -- bi-directional --.
Line 20, change "of and" to -- of loading and --.
Line 47, change "is" to -- are --.

Column 4,
Line 9, change "roller 20" to -- rollers 20 --.
Line 22, change "attachment" to -- attachments --.

Column 5,
Line 39, change "bidirectional" to -- bi-directional --.
Line 41, change "the polish" to -- polish the --.
Line 63, remove "also".

Column 6,
Line 16, change "will be" to -- will now be --.

Column 7,
Line 13, change "spun" to -- spin --.

UNITED STATES PATENT AND TRADEMARK OFFICE

CERTIFICATE OF CORRECTION

PATENT NO. : 6,103,628
DATED : August 15, 2000
INVENTOR(S) : Homayoun Talieh

It is certified that error appears in the above-identified patent and that said Letters Patent is hereby corrected as shown below:

Column 8,
Lines 6, 14 and 26, change "bidirectional" to -- bi-directional --.

Signed and Sealed this

Fourth Day of December, 2001

*Attest:*

Nicholas P. Godici

*Attesting Officer*

NICHOLAS P. GODICI
*Acting Director of the United States Patent and Trademark Office*